US010173098B1

(12) United States Patent
Chang

(10) Patent No.: US 10,173,098 B1
(45) Date of Patent: Jan. 8, 2019

(54) TREADMILL WITH ARCUATE WALKING BOARD

(71) Applicant: Ming Train Ltd., Taichung (TW)

(72) Inventor: Li-Li Chang, Taichung (TW)

(73) Assignee: Ming Train Ltd., Taichung (TW)

( * ) Notice: Subject to any disclaimer, the term of this patent is extended or adjusted under 35 U.S.C. 154(b) by 0 days.

(21) Appl. No.: 15/730,810

(22) Filed: Oct. 12, 2017

(51) Int. Cl.

| | |
|---|---|
| ***A63B 22/00*** | (2006.01) |
| ***A63B 22/02*** | (2006.01) |
| *A63B 21/015* | (2006.01) |
| *A63B 23/04* | (2006.01) |

(52) U.S. Cl.
CPC ..... *A63B 22/0285* (2013.01); *A63B 22/0242* (2013.01); *A63B 21/015* (2013.01); *A63B 23/04* (2013.01)

(58) Field of Classification Search
None
See application file for complete search history.

(56) References Cited

U.S. PATENT DOCUMENTS

| | | | | |
|---|---|---|---|---|
| 4,886,266 | A * | 12/1989 | Trulaske | A63B 22/0023 482/54 |
| 4,938,473 | A * | 7/1990 | Lee | A63B 22/02 482/27 |
| 5,320,589 | A * | 6/1994 | Singleton | A63B 22/02 482/54 |
| 9,675,840 | B2 * | 6/2017 | Walstead, Jr. | A63B 22/0285 |
| 2016/0367851 | A1 * | 12/2016 | Astilean | B62K 7/00 |
| 2018/0214735 | A1 * | 8/2018 | Astilean | A63B 21/156 |

* cited by examiner

*Primary Examiner* — Stephen R Crow
(74) *Attorney, Agent, or Firm* — Alan D. Kamrath; Kamrath IP Lawfirm, P.A.

(57) ABSTRACT

A treadmill includes a frame having two arcuate side racks, an arcuate walking board secured on the frame and arranged between the two arcuate side racks, a walking belt surrounding the arcuate walking board and arranged between the two arcuate side racks, a plurality of guiding rollers mounted on each of the two arcuate side racks, and two flexible guide rails mounted on two sides of the walking belt respectively and abutting the guiding rollers, with the guiding rollers rolling on the two flexible guide rails. Each of the two flexible guide rails is provided with a convex portion, and each of the guiding rollers is provided with a concave portion abutting the convex portion of one of the two flexible guide rails.

10 Claims, 12 Drawing Sheets

TREADMILL WITH ARCUATE WALKING BOARD

BACKGROUND OF THE INVENTION

1. Field of the Invention

The present invention relates to an exercising machine and, more particularly, to a treadmill with an arcuate walking board.

2. Description of the Related Art

A conventional treadmill comprises a frame, an arcuate walking board secured on the frame, and a walking belt surrounding the arcuate walking board. However, the arcuate walking board has a curved profile so that the walking belt easily produces a translation along the arcuate walking board during a long-term utilization. In addition, the arcuate walking board has a curved profile so that the walking belt cannot fit the arcuate walking board exactly when the user is stepping on the walking belt, thereby easily producing a gap and noise during rotation of the walking belt.

BRIEF SUMMARY OF THE INVENTION

In accordance with the present invention, there is provided a treadmill comprising a frame having two arcuate side racks, an arcuate walking board secured on the frame and arranged between the two arcuate side racks, a walking belt surrounding the arcuate walking board and arranged between the two arcuate side racks, a plurality of guiding rollers mounted on each of the two arcuate side racks, and two flexible guide rails mounted on two sides of the walking belt respectively and abutting the guiding rollers, with the guiding rollers rolling on the two flexible guide rails.

Preferably, each of the two flexible guide rails is provided with a convex portion, and each of the guiding rollers is provided with a concave portion abutting the convex portion of one of the two flexible guide rails.

According to the primary advantage of the present invention, the concave portion of each of the guiding rollers rests on the convex portion of one of the two flexible guide rails, so that when the walking belt is rotated, the guiding rollers guide and restrict movement of the two flexible guide rails, thereby preventing the walking belt from being deviated rightward or leftward.

According to another advantage of the present invention, each of the two flexible guide rails has a flexible feature, so that when the walking belt is rotated, the guiding rollers rest on the two flexible guide rails and will not produce noise during rotation.

According to a further advantage of the present invention, each of the guiding rollers is provided with a bearing, thereby facilitating transmission and rotation between the walking belt, the two flexible guide rails and the guiding rollers.

According to a further advantage of the present invention, when each of the two flexible guide rails is located at the outer face of the walking belt, the guiding rollers rest on the two flexible guide rails, so that the walking belt is restricted by the guiding rollers to fit the curve of the arcuate walking board, thereby reducing the gap and noise produced between the arcuate walking board and the walking belt during rotation of the walking belt.

According to a further advantage of the present invention, the conic roller presses and guides the walking belt, to prevent the walking belt from being translated rightward or leftward.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
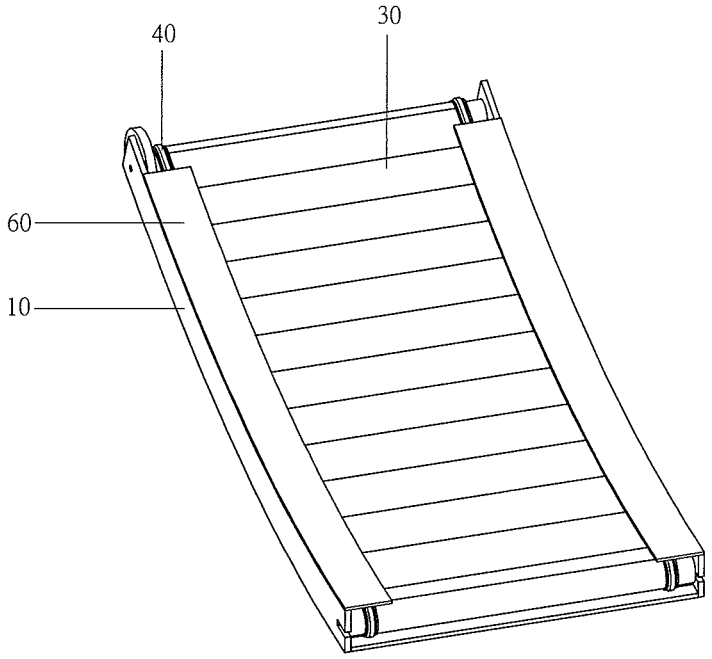
FIG. 1 is a perspective view of a treadmill in accordance with the preferred embodiment of the present invention.
Figure 2:
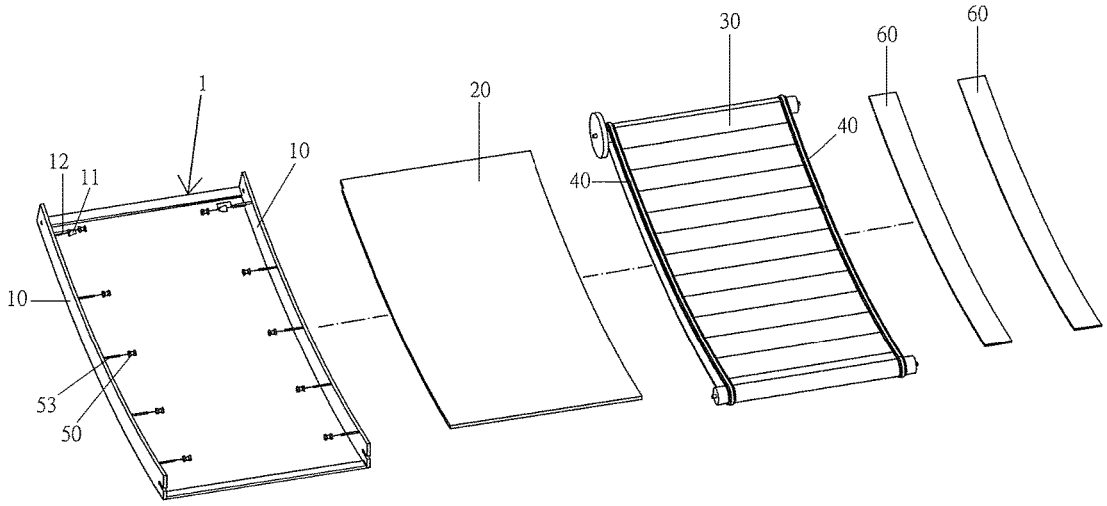
FIG. 2 is an exploded perspective view of the treadmill in accordance with the preferred embodiment of the present invention.
Figure 3:
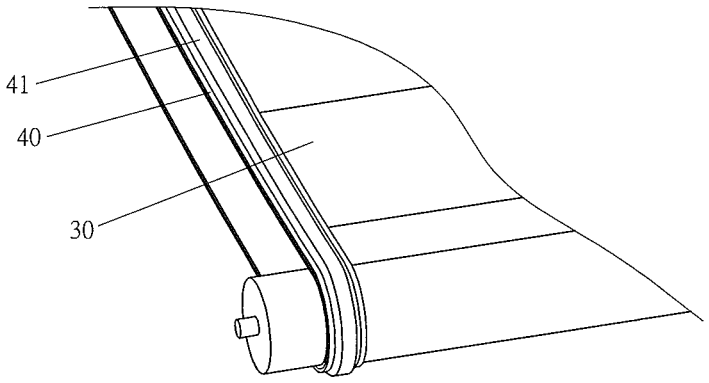
FIG. 3 is a locally enlarged perspective view of a walking belt of the treadmill in accordance with the preferred embodiment of the present invention.
Figure 4:
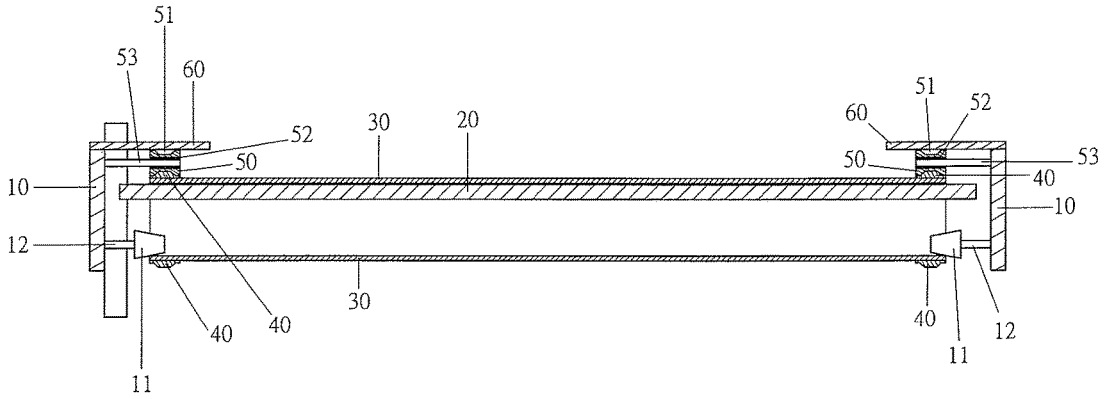
FIG. 4 is a cross-sectional view of the treadmill in accordance with the preferred embodiment of the present invention.
Figure 5:
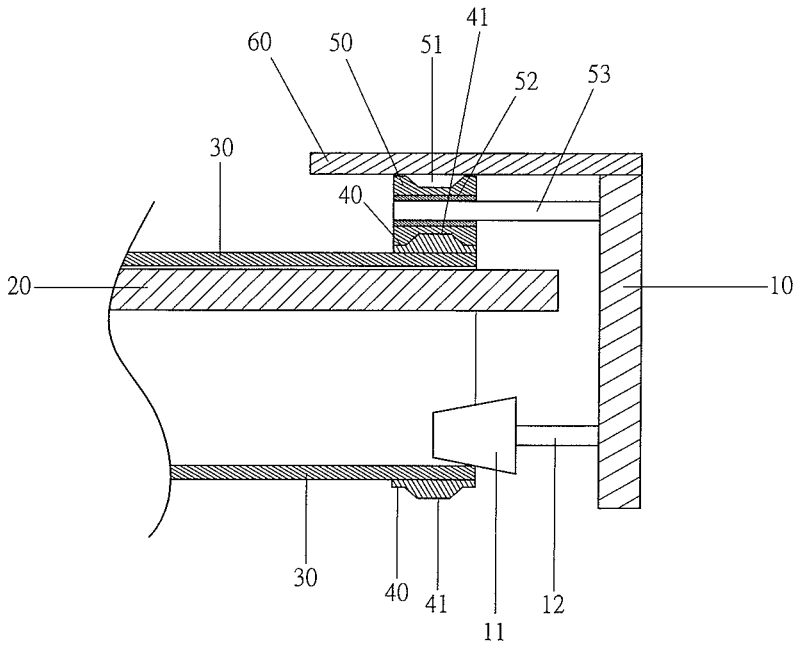
FIG. 5 is a locally enlarged view of the treadmill as shown in FIG. 4.
Figure 6:
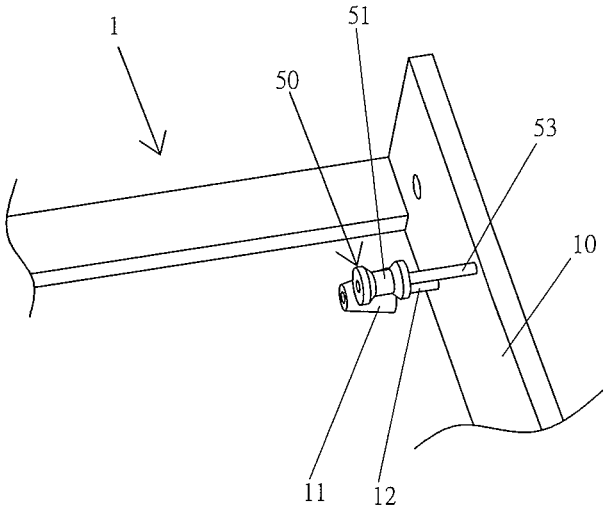
FIG. 6 is a locally enlarged perspective view of a guiding roller and a conic roller of the treadmill in accordance with the preferred embodiment of the present invention.
Figure 7:
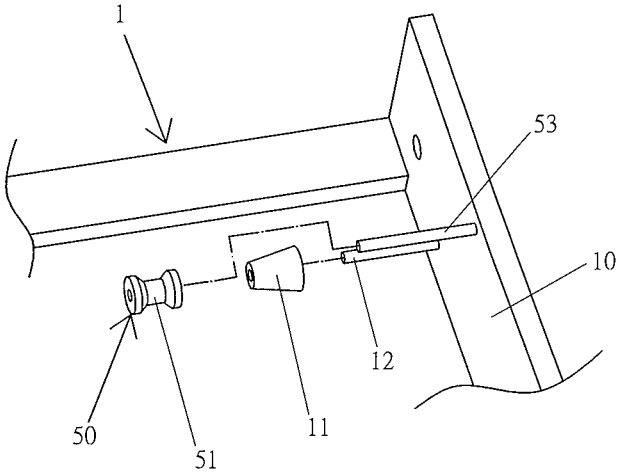
FIG. 7 is an exploded perspective view of the treadmill as shown in FIG. 4.

Referring to the drawings and initially to FIGS. 1-7, a treadmill in accordance with the preferred embodiment of the present invention comprises a frame 1 having two arcuate side racks 10, an arcuate walking board 20 secured on the frame 1 and arranged between the two arcuate side racks 10, a walking belt 30 surrounding the arcuate walking board 20 and arranged between the two arcuate side racks 10, a plurality of guiding rollers 50 mounted on each of the two arcuate side racks 10, and two flexible guide rails 40 mounted on two sides of the walking belt 30 respectively and abutting the guiding rollers 50, with the guiding rollers 50 rolling on the two flexible guide rails 40. The two arcuate side racks 10 are parallel with each other. The walking belt 30 has an endless shape. Each of the two flexible guide rails 40 is made of rubber and has an endless shape. The guiding rollers 50 are arranged on an inner face of each of the two arcuate side racks 10 and are spaced from each other.

In the preferred embodiment of the present invention, each of the guiding rollers 50 is rotatably mounted on a shaft 53 which is secured to one of the two arcuate side racks 10.

In the preferred embodiment of the present invention, each of the guiding rollers 50 has a center provided with a bearing 52.

In the preferred embodiment of the present invention, each of the two flexible guide rails 40 is located at an outer face of the walking belt 30.

In the preferred embodiment of the present invention, each of the two flexible guide rails 40 is a flexible belt.

In the preferred embodiment of the present invention, each of the two flexible guide rails 40 is provided with a convex portion 41, and each of the guiding rollers 50 is provided with a concave portion 51 abutting the convex portion 41 of one of the two flexible guide rails 40.

In the preferred embodiment of the present invention, each of the two arcuate side racks 10 is provided with an axle 12 and a conic roller 11 rotatably mounted on the axle 12 and abutting an inner face of the walking belt 30.

In the preferred embodiment of the present invention, the walking belt 30 includes a plurality of sheet plates 31 juxtaposed to each other.

In the preferred embodiment of the present invention, each of the two arcuate side racks 10 is provided with an ornamental plate 60 which is located above and covers one of the two flexible guide rails 40.

Figure 8:
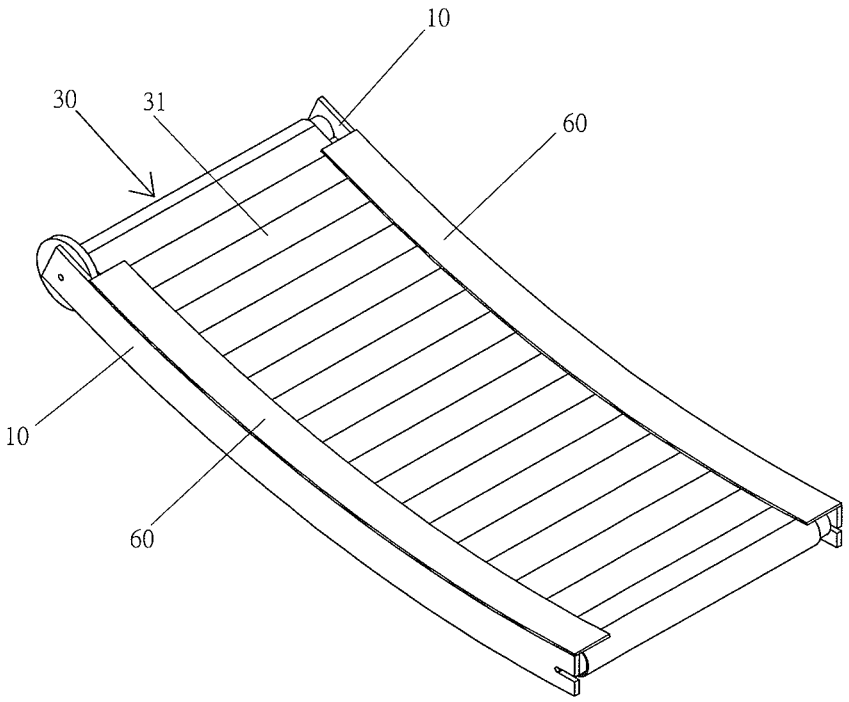
FIG. 8 is a perspective view of a treadmill in accordance with another preferred embodiment of the present invention.
Figure 9:
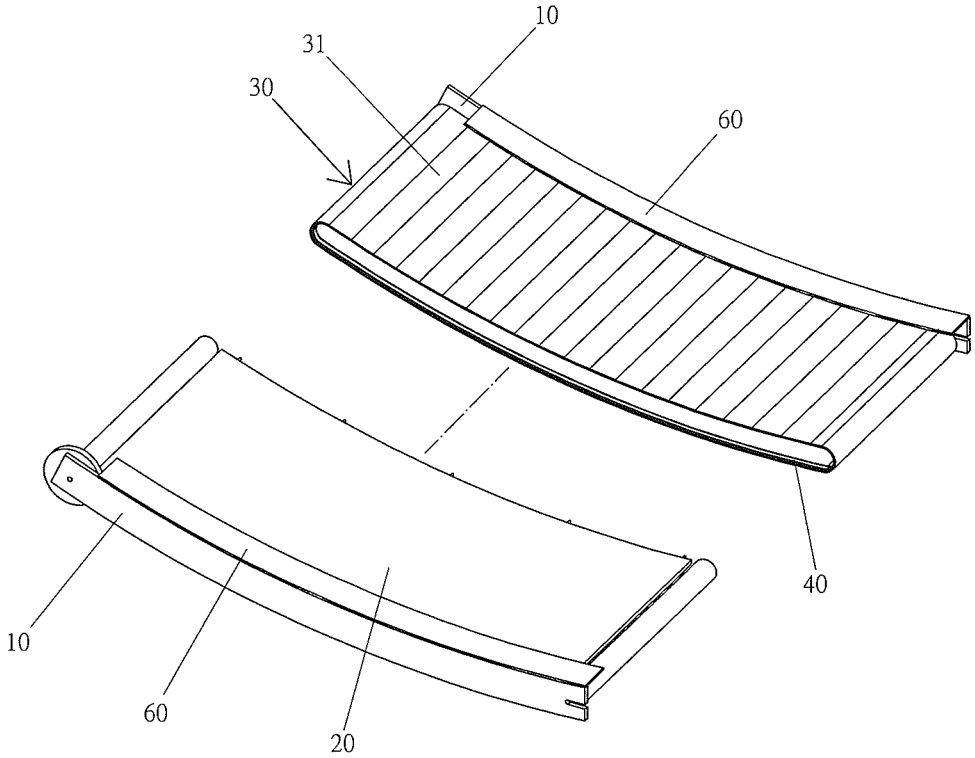
FIG. 9 is a partially exploded perspective view of the treadmill as shown in FIG. 8.
Figure 10:
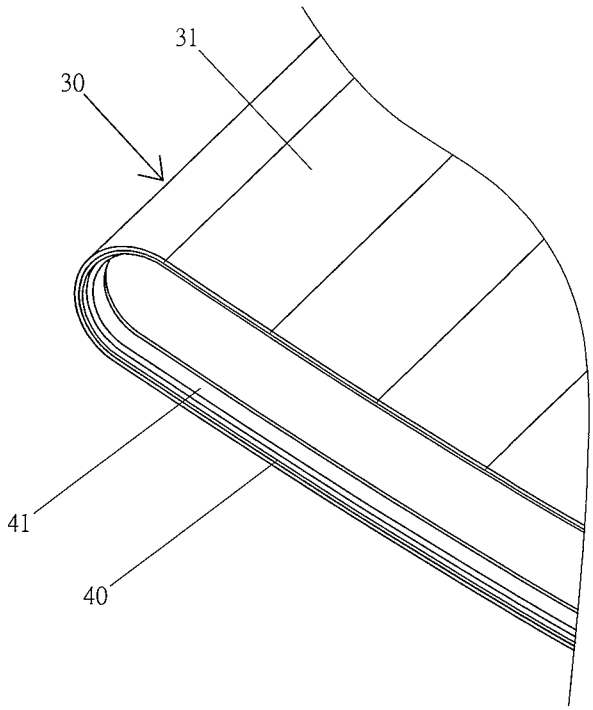
FIG. 10 is a locally enlarged perspective view of a walking belt of the treadmill as shown in FIG. 8.
Figure 11:
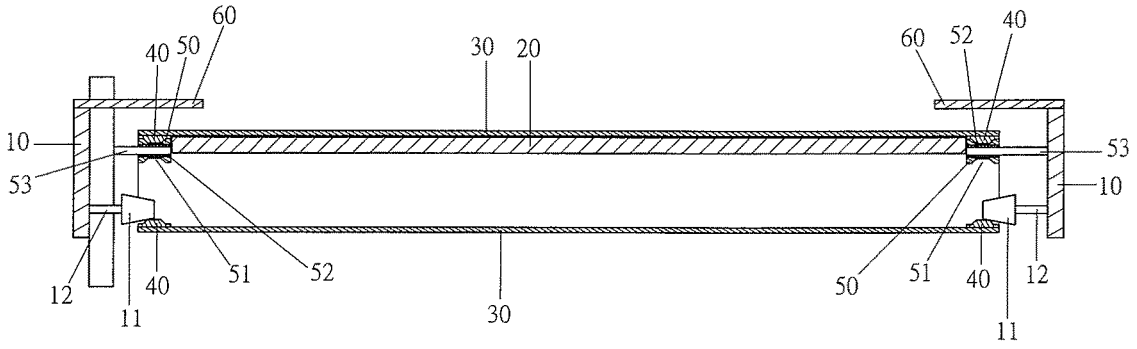
FIG. 11 is a cross-sectional view of the treadmill as shown in FIG. 8.
Figure 12:
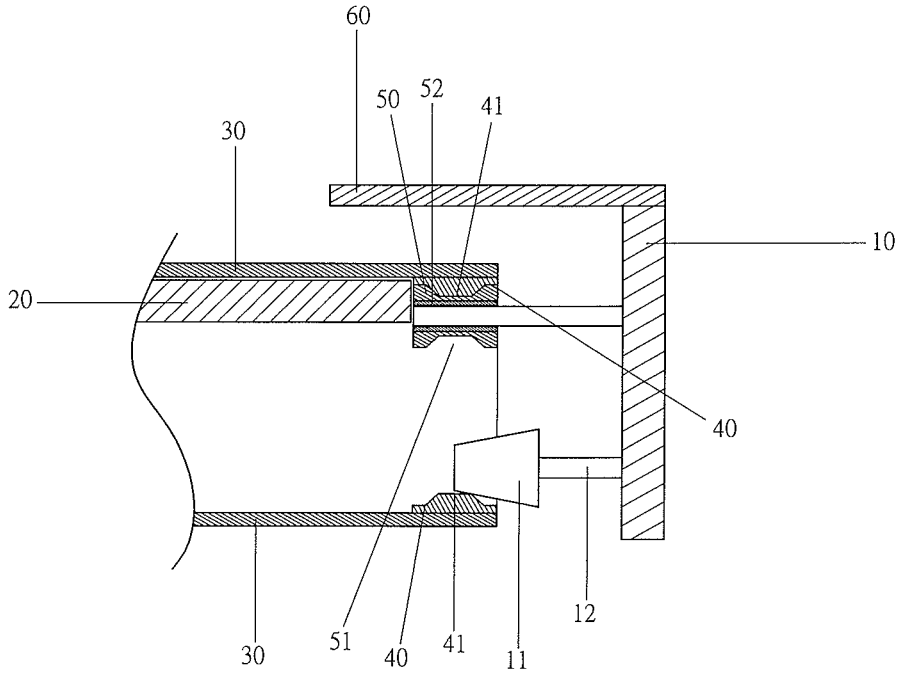
FIG. 12 is a locally enlarged view of the treadmill as shown in FIG. 11.

Referring to FIGS. 8-12, each of the two flexible guide rails 40 is located at an inner face of the walking belt 30.

Accordingly, the concave portion 51 of each of the guiding rollers 50 rests on the convex portion 41 of one of the two flexible guide rails 40, so that when the walking belt 30 is rotated, the guiding rollers 50 guide and restrict movement of the two flexible guide rails 40, thereby preventing the walking belt 30 from being deviated rightward or leftward. In addition, each of the two flexible guide rails 40 has a flexible feature, so that when the walking belt 30 is rotated, the guiding rollers 50 rest on the two flexible guide rails 40 and will not produce noise during rotation. Further, each of the guiding rollers 50 is provided with a bearing 52, thereby facilitating transmission and rotation between the walking belt 30, the two flexible guide rails 40 and the guiding rollers 50. Further, when each of the two flexible guide rails 40 is located at the outer face of the walking belt 30, the guiding rollers 50 rest on the two flexible guide rails 40, so that the walking belt 30 is restricted by the guiding rollers 50 to fit the curve of the arcuate walking board 20, thereby reducing the gap and noise produced between the arcuate walking board 20 and the walking belt 30 during rotation of the walking belt 30. Further, the conic roller 11 presses and guides the walking belt 30, to prevent the walking belt 30 from being translated rightward or leftward.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A treadmill comprising: a frame having two arcuate side racks; an arcuate walking board secured on the frame and arranged between the two arcuate side racks; a walking belt surrounding the arcuate walking board and arranged between the two arcuate side racks; a plurality of guiding rollers mounted on each of the two arcuate side racks; and two flexible guide rails mounted on two lateral sides of the walking belt respectively and abutting the guiding rollers, with the guiding rollers rolling on the two flexible guide rails.

2. The treadmill of claim 1, wherein each of the guiding rollers is rotatably mounted on a shaft which is secured to one of the two arcuate side racks.

3. The treadmill of claim 1, wherein each of the guiding rollers has a center provided with a bearing.

4. The treadmill of claim 1, wherein each of the two flexible guide rails is located at an outer face of the walking belt.

5. The treadmill of claim 1, wherein each of the two flexible guide rails is a flexible belt.

6. The treadmill of claim 1, wherein each of the two flexible guide rails is provided with a convex portion, and each of the guiding rollers is provided with a concave portion abutting the convex portion of one of the two flexible guide rails.

7. The treadmill of claim 1, wherein each of the two arcuate side racks is provided with an axle and a conic roller rotatably mounted on the axle and abutting an inner face of the walking belt.

8. The treadmill of claim 1, wherein the walking belt includes a plurality of sheet plates juxtaposed to each other.

9. The treadmill of claim 1, wherein each of the two arcuate side racks is provided with an ornamental plate which is located above and covers one of the two flexible guide rails.

10. The treadmill of claim 1, wherein each of the two flexible guide rails is located at an inner face of the walking belt.

* * * * *